US009890670B2

(12) United States Patent
Son et al.

(10) Patent No.: US 9,890,670 B2
(45) Date of Patent: Feb. 13, 2018

(54) CONTINUOUS VARIABLE VALVE LIFT APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR); Kiyoung Kwon, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 156 days.

(21) Appl. No.: 14/955,952

(22) Filed: Dec. 1, 2015

(65) Prior Publication Data

US 2017/0081995 A1 Mar. 23, 2017

(30) Foreign Application Priority Data

Sep. 21, 2015 (KR) ..... 10-2015-0133340

(51) Int. Cl.

| | |
|---|---|
| ***F01L 1/16*** | (2006.01) |
| ***F01L 13/00*** | (2006.01) |
| ***F01L 1/18*** | (2006.01) |
| ***F01L 1/24*** | (2006.01) |
| ***F01L 1/26*** | (2006.01) |

(52) U.S. Cl.

CPC ..... *F01L 13/0015* (2013.01); *F01L 1/18* (2013.01); *F01L 1/185* (2013.01); *F01L 1/2405* (2013.01); *F01L 1/26* (2013.01); *F01L 1/267* (2013.01); *F01L 13/00* (2013.01); *F01L 13/0026* (2013.01); *F01L 13/0063* (2013.01); *F01L 2013/0068* (2013.01); *F01L 2013/0084* (2013.01); *F01L 2105/00* (2013.01)

(58) Field of Classification Search

CPC . F01L 13/0015; F01L 2013/0084; F01L 1/18; F01L 1/185; F01L 1/2405; F01L 1/26; F01L 1/267; F01L 13/00; F01L 13/0026; F01L 2013/0068; F01L 2105/00

See application file for complete search history.

(56) References Cited

U.S. PATENT DOCUMENTS

2013/0146006 A1* 6/2013 Kim ..... F01L 1/0532 123/90.17

FOREIGN PATENT DOCUMENTS

| | | |
|---|---|---|
| JP | 2015-117692 A | 6/2015 |
| KR | 10-2010-0047673 A | 5/2010 |

* cited by examiner

*Primary Examiner* — Zelalem Eshete

(74) *Attorney, Agent, or Firm* — Morgan, Lewis & Bockius LLP

(57) ABSTRACT

A continuously variable valve lift apparatus may include a camshaft, a cam portion on which a cam is formed and into which the camshaft is inserted, a slider housing into which the cam portion is rotatably inserted and of which a position is rotatable around a pivot shaft, a control portion engaged with the slider housing and configured to selectively rotate the slider housing around the pivot shaft, an output portion rotatable around the pivot shaft, contacting the cam and onto which a valve shoe is formed, and a valve device contacting the valve shoe and driven by rotation of the cam.

18 Claims, 10 Drawing Sheets

CONTINUOUS VARIABLE VALVE LIFT APPARATUS AND ENGINE PROVIDED WITH THE SAME

CROSS-REFERENCE TO RELATED APPLICATION

The present application claims priority to Korean Patent Application No. 10-2015-0133340 filed Sep. 21, 2015, the entire contents of which is incorporated herein for all purposes by this reference.

BACKGROUND OF THE INVENTION

Field of the Invention

The present invention relates to a continuous variable valve lift apparatus and an engine provided with the same. More particularly, the present invention relates to a continuous variable valve lift apparatus an engine provided with the same which may vary valve lift according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve lift apparatus and an engine provided with the same which may vary valve lift according to operation conditions of an engine, with a simple construction.

According to various aspects of the present invention, a continuously variable valve lift apparatus may include a camshaft, a cam portion on which a cam is formed and into which the camshaft is inserted, a slider housing into which the cam portion is rotatably inserted and of which a position is rotatable around a pivot shaft, a control portion engaged with the slider housing and configured to selectively rotate the slider housing around the pivot shaft, an output portion rotatable around the pivot shaft, contacting the cam and onto which a valve shoe is formed, and a valve device contacting the valve shoe and driven by rotation of the cam.

A slider gear may be formed to the slider housing, and the control portion may include a gear lifter onto which a control gear engaged with the slider gear is formed.

A center of tooth of the slider gear is the pivot shaft.

The continuously variable valve lift apparatus may further include a connecting pin connected to the camshaft, and a spiral bearing mounted to the cam portion and into which the connecting pin is inserted.

The spiral bearing may include an outer wheel connected to a driving hole formed to the cam portion, and an inner wheel rotatably connected to the outer wheel and in which the connecting pin is slidably disposed.

The continuously variable valve lift apparatus may further include a bearing disposed between the cam portion and the slider housing.

The output portion may include an output roller contacting the cam.

The continuously variable valve lift apparatus may further include a spring bracket connected to the slider housing, and a torsion spring connected to the spring bracket for the output portion to contact the cam.

The valve device may be a swing arm comprising a swing arm roller contacting the valve shoe and a valve.

The slider housing may be disposed as a pair, and the cam portion may include a center portion formed to a center thereof, and two rotation portions formed on both sides of the cam portion and rotatably disposed within each slider housing of the pair, and cams of the cam as a pair may be formed between the center portion and each rotation portion.

The continuously variable valve lift apparatus may further include a connecting pin connected to the camshaft, and a spiral bearing mounted to the center portion and into which the connecting pin is inserted.

The continuously variable valve lift apparatus may further include a spring bracket connected to each slider housing, and a torsion spring connected to the spring bracket for each output portion to contact each cam.

The output portion may be disposed as a pair and each output portion of the pair contacts each the cam, and the valve device may be a swing arm disposed as a pair and include a swing arm roller contacting the valve shoe and a valve.

According to various aspects of the present invention, an engine may include a camshaft, a cam portion on which a cam is formed and into which the camshaft is inserted, a slider housing into which the cam portion is rotatably inserted, of which a position is rotatable around a pivot shaft and on which a slider gear is formed, a control portion including a gear lifter on which a control gear engaged with the slider housing is formed, the control portion configured to selectively rotate the slider housing around the pivot shaft, an output portion rotatable around the pivot shaft, contacting the cam and on which a valve shoe is formed, and a valve device contacting the valve shoe and configured to be driven by rotation of the cam.

The slider housing may be disposed as a pair and each slider housing of the pair is rotatable around the pivot shaft, two rotation portions rotatably disposed within each slider housing may be formed on both sides of the cam portion, the cam may be formed to the cam portion as a pair and a center portion may be formed between the cams, the output portion may be disposed as a pair and contact each cam, and the valve device may be a swing arm disposed as a pair and include a swing arm roller contacting to the valve shoe and a valve.

The engine may further include a spring bracket connected to the slider housings, and a torsion spring connected to the spring bracket for each output portion to be contacted with each cam.

The engine may further include a connecting pin connected to the camshaft, and a spiral bearing mounted to the center portion and into which the connecting pin is inserted, in which the spiral bearing may include an outer wheel connected to a driving hole formed to the center portion, and an inner wheel rotatably connected to the outer wheel and in which the connecting pin is slidably disposed.

The engine may further include a bearing disposed between the cam portion and the slider housing.

As described above, a continuous variable valve lift apparatus according to various embodiments of the present invention may vary valve lift according to operation conditions of an engine, with a simple construction.

The continuous variable valve lift apparatus according to various embodiments of the present invention may reduce duration in minimum valve lift comparing to general continuous variable valve lift apparatuses.

The continuous variable valve lift apparatus according to various embodiments of the present invention may advance closing timing of an intake valve so that may reduce pumping loss and enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
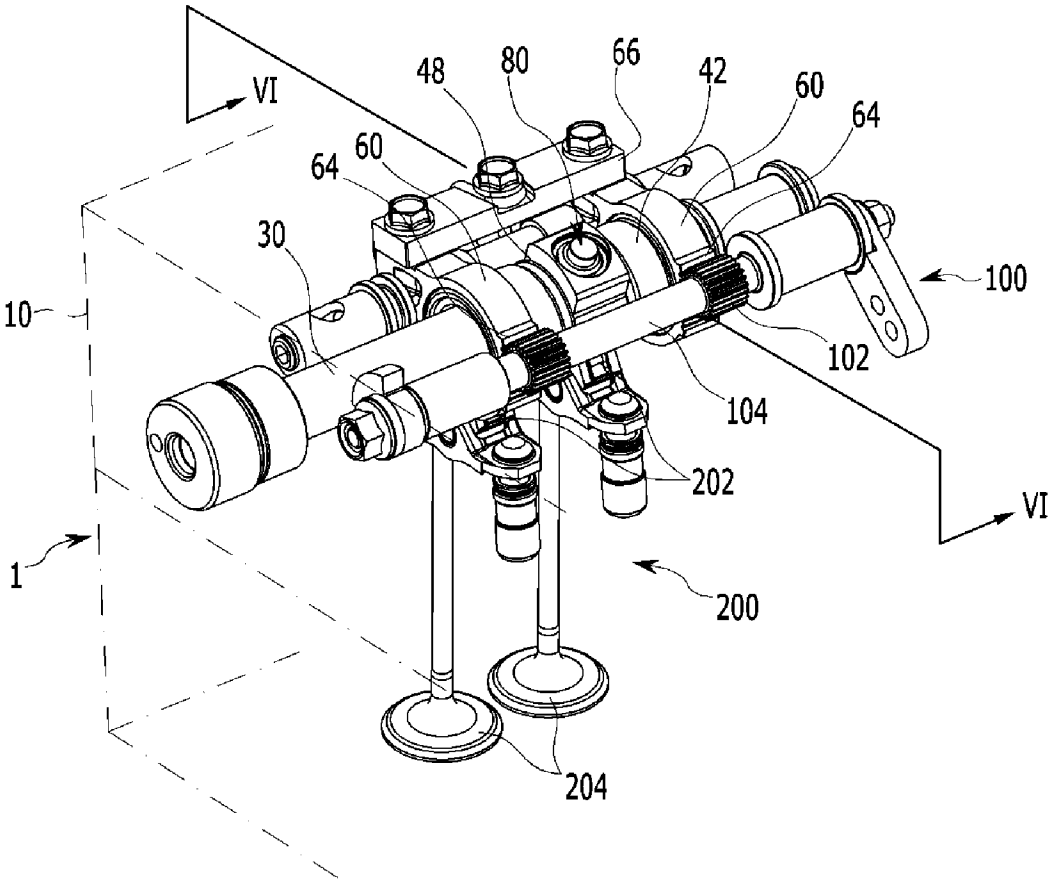
FIG. 1 is a perspective view of an exemplary continuous variable valve lift apparatus according to the present invention.
Figure 2:
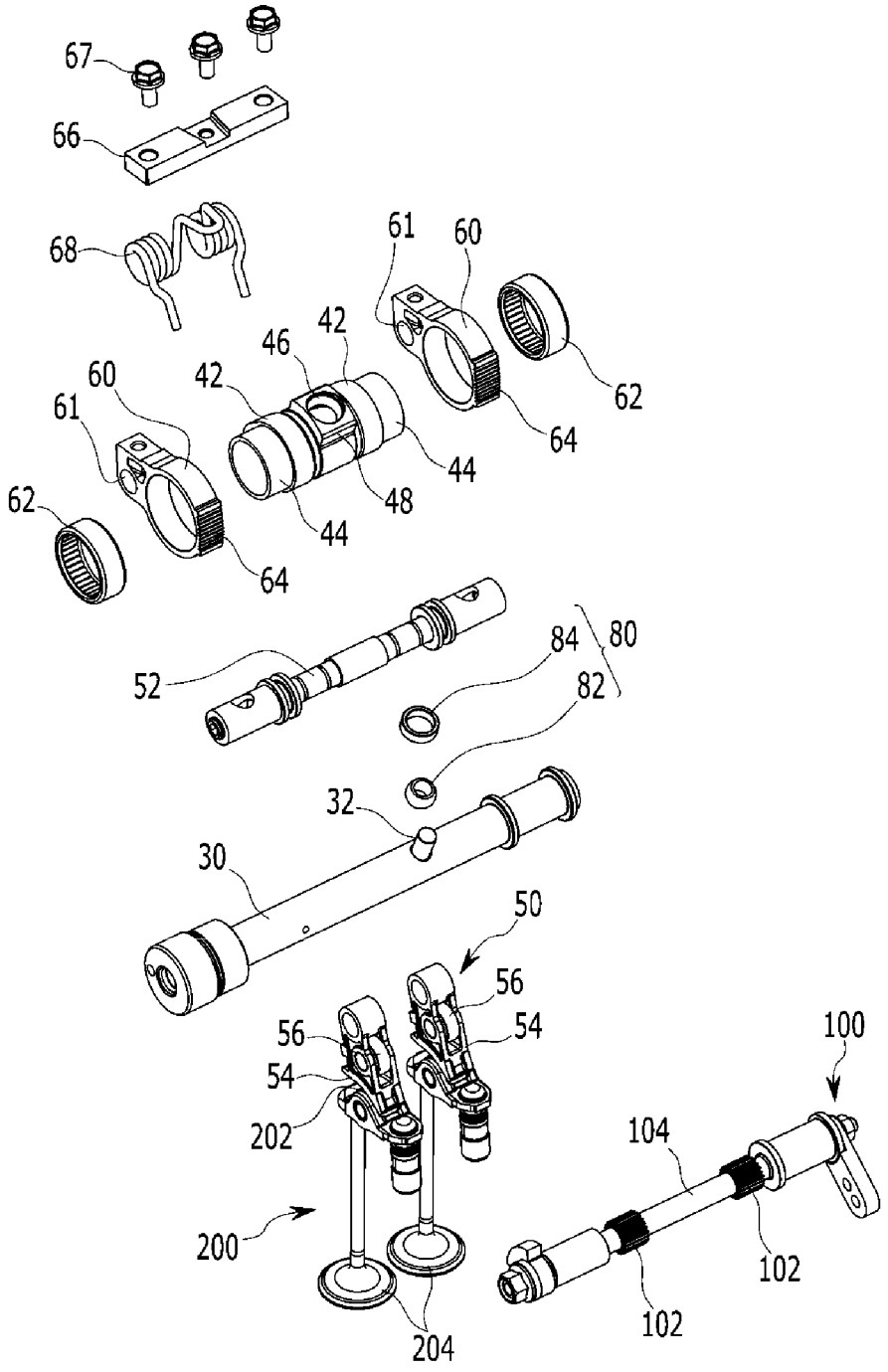
FIG. 2 is an exploded perspective view of the exemplary continuous variable valve lift apparatus according to the present invention.

FIG. 1 is a perspective view of a continuous variable valve lift apparatus according to various embodiments of the present invention and FIG. 2 is an exploded perspective view of a continuous variable valve lift apparatus according to various embodiments of the present invention.

Figure 3:
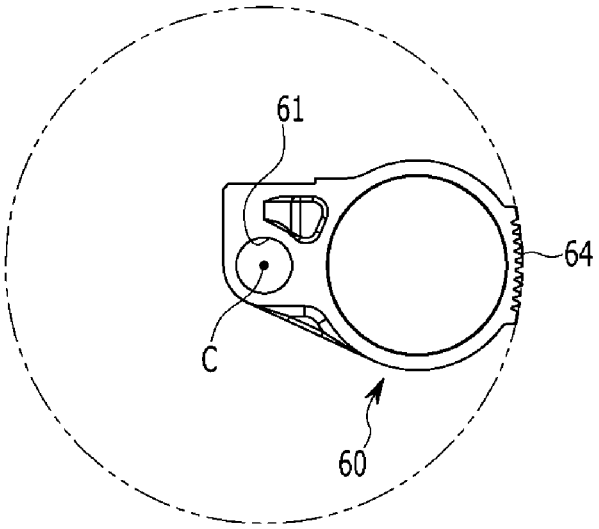
FIG. 3 is a drawing showing a slider housing applied to the exemplary continuous variable valve lift apparatus according to the present invention.
Figure 4:
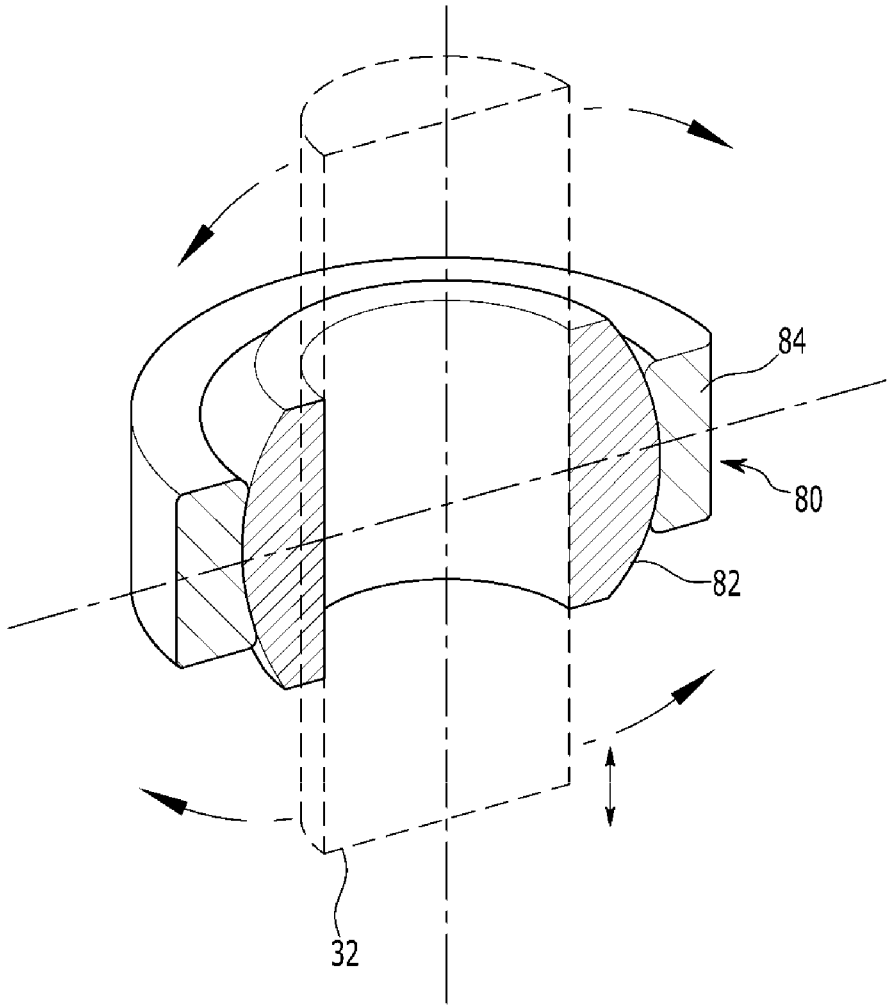
FIG. 4 is a cross-sectional view of a spiral bearing provided to the exemplary continuous variable valve lift apparatus according to the present invention.

FIG. 3 is a drawing showing a slider housing applied to a continuous variable valve lift apparatus according to various embodiments of the present invention and FIG. 4 is a cross-sectional view of a spiral bearing provided to a continuous variable valve lift apparatus according to various embodiments of the present invention.

Referring to FIG. 1 to FIG. 4, an engine 1 according to various embodiments of the present invention includes a cylinder head 10 and a continuous variable valve lift apparatus mounted to the cylinder head 10.

The continuously variable valve lift apparatus according to various embodiments of the present invention includes a camshaft 30, a cam portion 40 of which a cam 42 is formed thereto and the camshaft 30 is inserted into therein, a slider housing 60 of which the cam portion 40 is rotatably inserted therein and of which a position is rotatable around a pivot shaft 52, a control portion 100 engaged with the slider housing 60 and selectively rotating the slider housing 60 around the pivot shaft 52, an output portion 50 rotatable around the pivot shaft 52, contacting to the cam 42 and of which a valve shoe 54 is formed thereto and a valve device 200 contacting to the valve shoe 54 and driven by rotation of the cam 54.

In the detailed description and claims, the cylinder head 10 is interpreted as including a cam carrier.

A slider gear 64 is formed to the slider housing 60, and the control portion 100 includes a gear lifter 104 of which a control gear 102 engaged with the slider gear 64 is formed thereto.

A rotation hole 61 is formed to the slider housing 60 and the pivot shaft 52 is inserted thereto.

Referring to FIG. 3, a center of tooth of the slider gear 64 is the pivot shaft 54. That is, when a control motor or an actuator rotates the gear lifter 104 according to operation state of the engine, the slider housing 60 engaged with the control gear 102 through the slider gear 64 which rotates around the pivot shaft 52.

A connecting pin 32 is connected to the camshaft 30 and a spiral bearing 80 is mounted to the cam portion 40 and the connecting pin 32 is inserted into the spiral bearing 80.

A center portion 48 is formed to a center of the cam portion 40 and the spiral bearing 80 include an outer wheel 84 connected to a driving hole 46 formed to the center portion 48 and an inner wheel 82 rotatably connected to the outer wheel 84 and of which the connecting pin 32 is slidably disposed therein.

The output portion 50 includes an output roller 56 contacting to the cam 42.

A spring bracket 66 is connected to the slider housing 60 and a torsion spring 68 is connected to the spring bracket 66 through bolts 67 for the output portion 50 to be contacted with the cam 42.

The valve device 200 may be a swing arm including a swing arm roller 202 contacting to the valve shoe 54 and a valve 204.

A bearing 62 is disposed between the cam portion 40 and the slider housing 62. Thus, rotation of the cam portion 40 may be easily performed. In the drawings, the bearing 62 is depicted as a needle bearing, however it is not limited thereto. On the contrary, various bearings such as a ball bearing, a roller bearing and so on may be applied thereto.

The slider housing 60 is disposed as a pair and the cam portion 40 includes a center portion 48 formed to a center thereof and two rotation portions 44 formed both sides of the cam portion 40 and rotatably disposed within each slider housing 60. And the cam 42 as a pair is formed between the center portion 48 and each rotation portion 44.

The output portion 50 may be disposed as a pair contacting to each cam 42 and the valve device 200 may be two swing arms.

Figure 5:
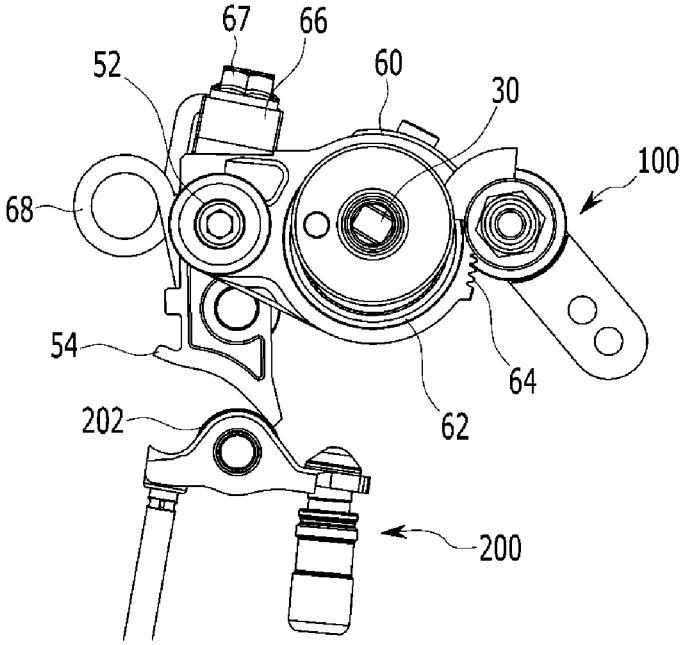
FIG. 5 is a front view of the exemplary continuous variable valve lift apparatus according to the present invention operated in a high lift mode.
Figure 6:
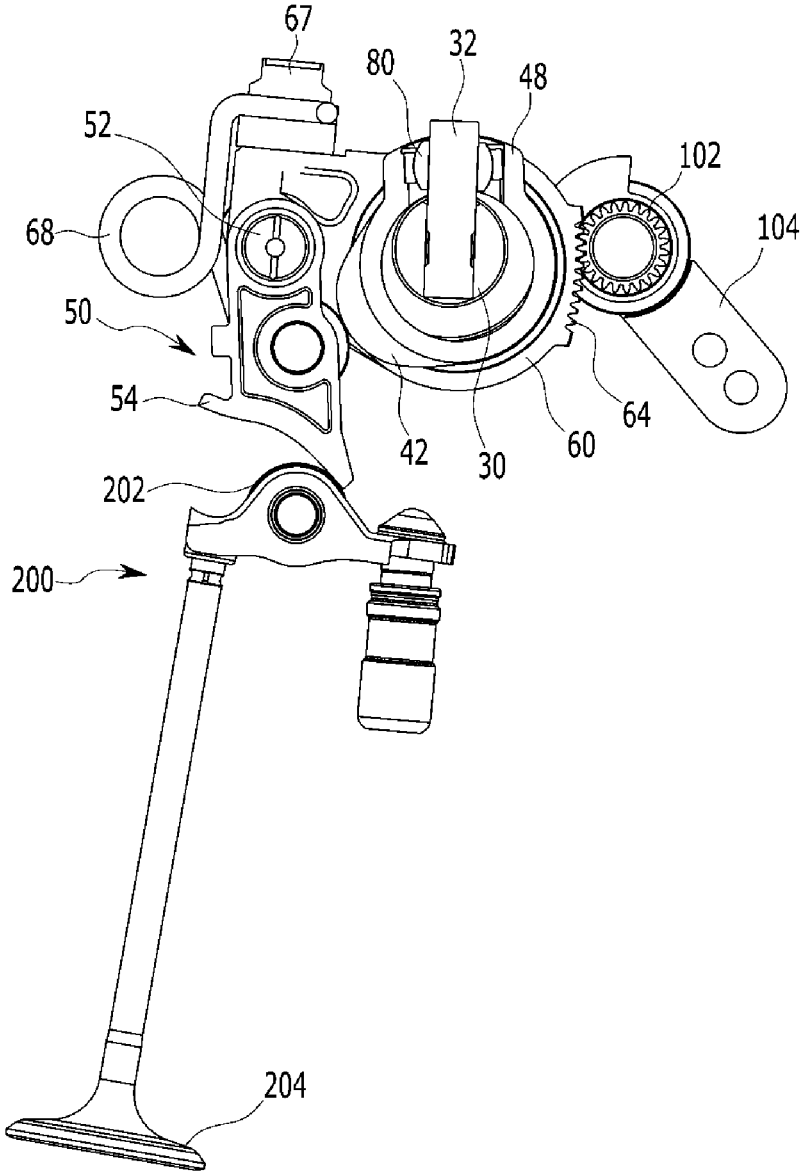
FIG. 6 is a cross-sectional view along line-of FIG. 1 showing operations in the high lift mode of the exemplary continuous variable valve lift apparatus according to the present invention.

FIG. 5 is a front view of a continuous variable valve lift apparatus according to various embodiments of the present invention operated in high lift mode and FIG. 6 is a cross-sectional view along line-of FIG. 1 showing operations in a high lift mode of a continuous variable valve lift apparatus according to various embodiments of the present invention.

Figure 7:
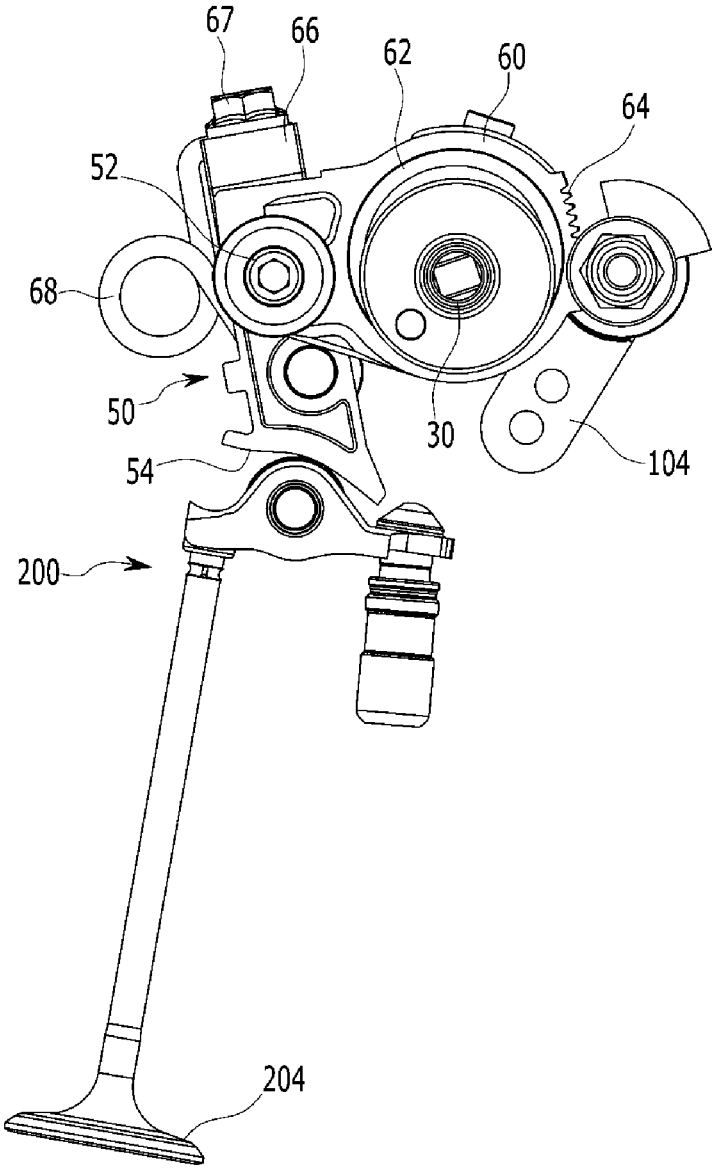
FIG. 7 is a front view of the exemplary continuous variable valve lift apparatus according to the present invention operated in a low lift mode.
Figure 8:
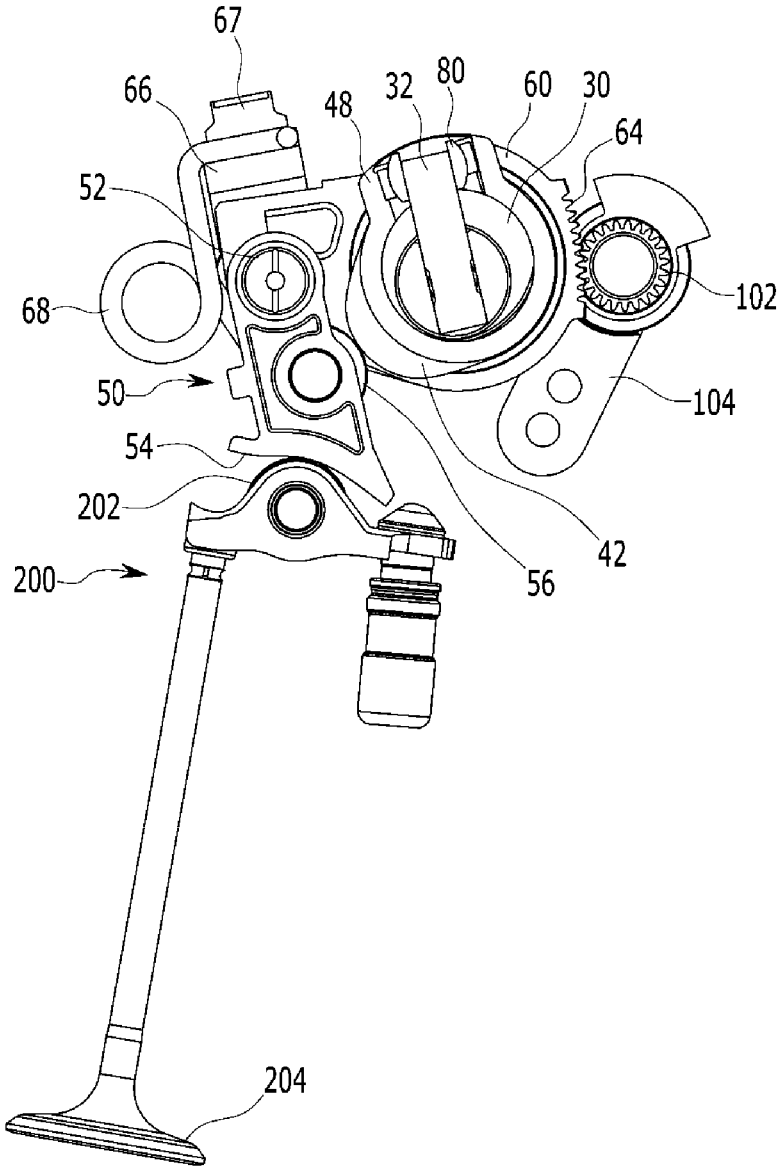
FIG. 8 is a cross-sectional view along line-of FIG. 1 showing operations in the low lift mode of the exemplary continuous variable valve lift apparatus according to the present invention.

FIG. 7 is a front view of a continuous variable valve lift apparatus according to various embodiments of the present invention operated in low lift mode and FIG. 8 is a cross-sectional view along line-of FIG. 1 showing operations in a low lift mode of a continuous variable valve lift apparatus according to various embodiments of the present invention.

Hereinafter, referring to FIG. 1 to FIG. 8, operations of the continuously variable valve lift apparatus according to various embodiments of the present invention will be described.

When the rotation centers of the camshaft 30 and the cam portion 40 are coincident, the valve 204 realizes a predetermined valve lift profile.

According to engine operation states, the (Engine Control Unit or Electronic Control Unit) ECU transmits control signals to the control portion 100 to change the relative position of the slider housing 60. As shown FIG. 6 and in FIG. 6, for example, in high lift mode requiring high power, the slider housing 60 rotates in a clockwise direction around the pivot shaft 52 according to the operation of the control portion 100.

Then the rotation centers of the camshaft 30 and the cam portion 40 are not coincident, the rotation of the camshaft 30 is transmitted to the cam portion 40 through the connecting pin 32 and the spiral bearing 80.

Since the relative rotation of the cam 42 is changed, the output portion 50 relatively rotates in a clockwise direction around the pivot shaft 52.

Since the output portion 50 relatively rotates in the clockwise direction around the pivot shaft 52, the contacting position of the valve shoe 54 to the swing arm roller 202 are changed to the right direction.

As shown FIG. 7 and in FIG. 8, for example, in low lift mode requiring low power, the slider housing 60 rotates in an anticlockwise direction around the pivot shaft 52 according to the operation of the control portion 100.

Then the rotation centers of the camshaft 30 and the cam portion 40 are not coincident, the rotation of the camshaft 30 is transmitted to the cam portion 40 through the connecting pin 32 and the spiral bearing 80.

Since the relative rotation of the cam 42 is changed, the output portion 50 relatively rotates in an anticlockwise direction around the pivot shaft 52.

Since the output portion 50 relatively rotates in the counterclockwise direction around the pivot shaft 52, the contacting position of the valve shoe 54 to the swing arm roller 202 are changed to the left direction.

In various embodiments of the present invention, according to the relative position of the slider housing 60 with respect to the camshaft 30, the rotation center of the cam 42 is changed and thus a contacting position of the output roller 56 and the cam 42 is changed. Thus, when the operation mode of the continuously variable valve lift apparatus is changed to the low lift mode, valve closing timing may be advanced.

Also, since the contacting position of the swing arm roller 202 and the valve shoe 54 is changed, the valve lift is adjusted.

Figure 9:
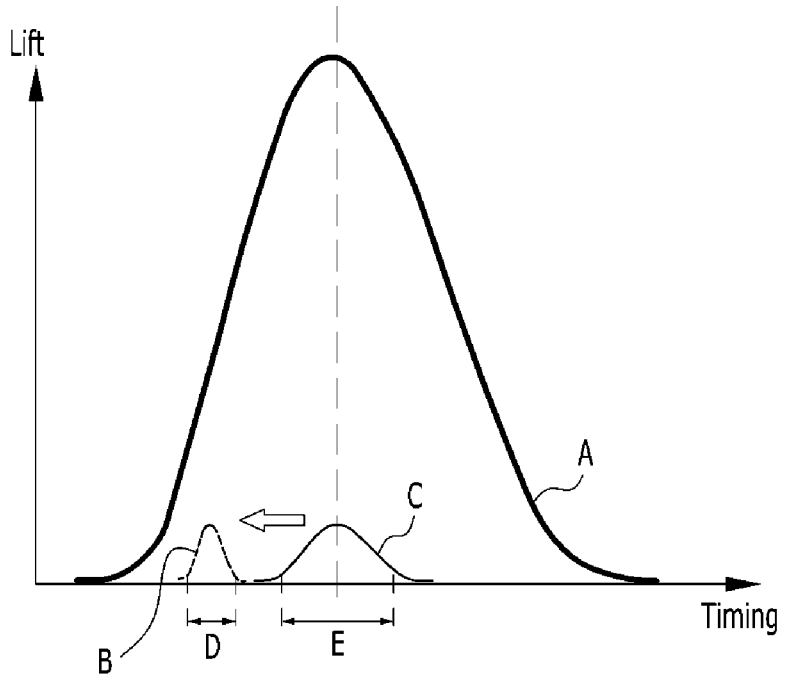
FIG. 9 is a graph of a valve profile of the exemplary continuous variable valve lift apparatus according to the present invention.

FIG. 9 is a graph of a valve profile of a continuous variable valve lift apparatus according to various embodiments of the present invention.

A high lift profile A or a low lift profile B of the valve 204 may be performed according to the relative rotation center of the cam 42 with respect to the camshaft 30, relative positions of the camshaft 30 and the output roller 56 and the contacting position of the valve shoe 54 and the swing arm roller 202.

While only the high lift profile A and the low lift profile B are shown in FIG. 9, however it is not limited thereto. The relative position of the slider housing 60 may perform various valve profiles.

As shown in FIG. 9, comparing to a valve duration C of a general continuously variable valve lift apparatus in the low lift mode, a valve duration D of the continuously variable valve lift apparatus according to various embodiments of the present invention may be reduced.

And valve closing time may be advanced comparing to valve closing time of the general continuously variable valve lift apparatus in the low lift mode due to contacting position change of the cam 42 and the output roller 56. Thus, pumping lose may be reduced and enhancement of fuel consumption may be realized.

Figure 10:
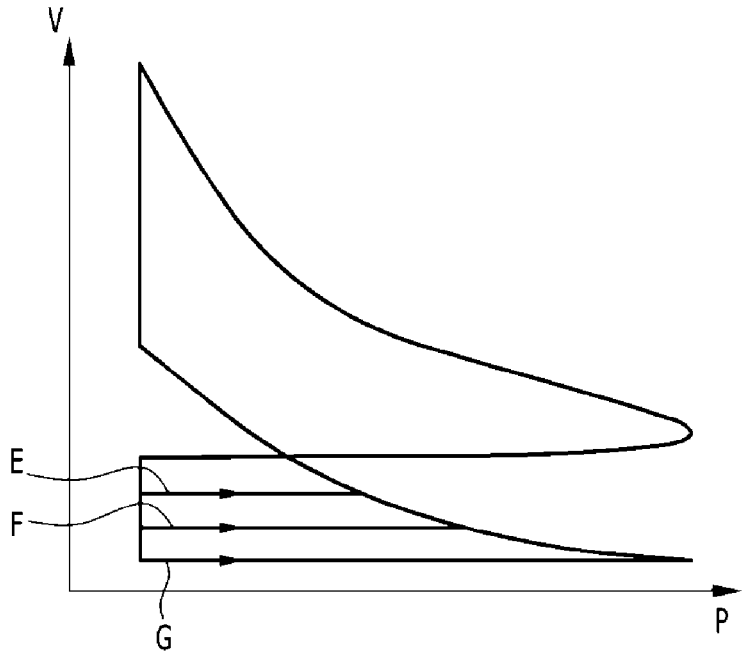
FIG. 10 is a graph of pressure volume diagram of an engine provided with the exemplary continuous variable valve lift apparatus according to the present invention.

FIG. 10 is a graph of pressure volume diagram of an engine provided with the continuous variable valve lift apparatus.

As shown in FIG. 10, an engine provided with a continuous variable valve lift apparatus may reduce pumping loss F comparing to pumping loss E of an engine without a continuous variable valve lift apparatus.

However, the continuously variable valve lift apparatus may reduce valve duration and advance valve closing time so that may reduce pumping loss G and may enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus comprising:

a camshaft;

a cam portion on which a cam is formed and into which the camshaft is inserted;

a slider housing into which the cam portion is rotatably inserted and of which a position is rotatable around a pivot shaft;

a control portion engaged with the slider housing and configured to selectively rotate the slider housing around the pivot shaft;

an output portion rotatable around the pivot shaft, contacting the cam and onto which a valve shoe is formed; and a valve device contacting the valve shoe and driven by rotation of the cam, wherein a slider gear is formed to the slider housing, and wherein the control portion comprises a gear lifter onto which a control gear engaged with the slider gear is formed.

2. The continuously variable valve lift apparatus of claim 1, wherein a center of tooth of the slider gear is the pivot shaft.

3. The continuously variable valve lift apparatus of claim 1, further comprising:

a connecting pin connected to the camshaft; and a spiral bearing mounted to the cam portion and into which the connecting pin is inserted.

4. The continuously variable valve lift apparatus of claim 3, wherein the spiral bearing comprises:

an outer wheel connected to a driving hole formed to the cam portion; and an inner wheel rotatably connected to the outer wheel and in which the connecting pin is slidably disposed.

5. The continuously variable valve lift apparatus of claim 1, further comprising a bearing disposed between the cam portion and the slider housing.

6. The continuously variable valve lift apparatus of claim 1, wherein the output portion comprises an output roller contacting the cam.

7. The continuously variable valve lift apparatus of claim 1, further comprising:

a spring bracket connected to the slider housing; and a torsion spring connected to the spring bracket for the output portion to contact the cam.

8. The continuously variable valve lift apparatus of claim 1, wherein the valve device is a swing arm comprising a swing arm roller contacting the valve shoe and a valve.

9. The continuously variable valve lift apparatus of claim 1, wherein:

the slider housing is disposed as a pair, and the cam portion comprises:

a center portion formed to a center thereof; and two rotation portions formed on both sides of the cam portion and rotatably disposed within each slider housing of the pair, and wherein cams of the cam as a pair are formed between the center portion and each rotation portion.

10. The continuously variable valve lift apparatus of claim 9, further comprising:

a connecting pin connected to the camshaft; and a spiral bearing mounted to the center portion and into which the connecting pin is inserted.

11. The continuously variable valve lift apparatus of claim 9, further comprising:

a spring bracket connected to each slider housing; and a torsion spring connected to the spring bracket for each output portion to contact each cam.

12. The continuously variable valve lift apparatus of claim 9, wherein:

the output portion is disposed as a pair and each output portion of the pair contacts each the cam; and the valve device is a swing arm disposed as a pair and comprises a swing arm roller contacting the valve shoe and a valve.

13. An engine comprising:

a camshaft;

a cam portion on which a cam is formed and into which the camshaft is inserted;

a slider housing into which the cam portion is rotatably inserted, of which a position is rotatable around a pivot shaft and on which a slider gear is formed;

a control portion including a gear lifter on which a control gear engaged with the slider housing is formed, the control portion configured to selectively rotate the slider housing around the pivot shaft;

an output portion rotatable around the pivot shaft, contacting the cam and on which a valve shoe is formed; and a valve device contacting the valve shoe and configured to be driven by rotation of the cam.

14. The engine of claim 13, wherein:

the slider housing is disposed as a pair and each slider housing of the pair is rotatable around the pivot shaft;

two rotation portions rotatably disposed within each slider housing are formed on both sides of the cam portion;

the cam is formed to the cam portion as a pair and a center portion is formed between the cams;

the output portion is disposed as a pair and contacts each cam; and the valve device is a swing arm disposed as a pair and comprising a swing arm roller contacting to the valve shoe and a valve.

15. The engine of claim 14, further comprising:

a spring bracket connected to the slider housings; and a torsion spring connected to the spring bracket for each output portion to be contacted with each cam.

16. The engine of claim 14, further comprising:

a connecting pin connected to the camshaft; and a spiral bearing mounted to the center portion and into which the connecting pin is inserted, wherein the spiral bearing comprises:

an outer wheel connected to a driving hole formed to the center portion; and an inner wheel rotatably connected to the outer wheel and in which the connecting pin is slidably disposed.

17. The engine of claim 14, further comprising a bearing disposed between the cam portion and the slider housing.

18. The engine of claim 13, wherein a center of tooth of the slider gear is the pivot shaft.

* * * * *